US006158856A

United States Patent [19]

Sato et al.

[11] Patent Number: 6,158,856

[45] **Date of Patent: *Dec. 12, 2000**

[54] INK-JET RECORDING PROCESS, INK-JET RECORDING APPARATUS AND IMAGE FORMED ARTICLE

[75] Inventors: Shinichi Sato; Jiro Moriyama, both of Kawasaki; Yutaka Kurabayashi, Tokorozawa; Masashi Ogasawara, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/598,385

[22] Filed: Feb. 8, 1996

[30] Foreign Application Priority Data

Feb. 13, 1995 [JP] Japan ..... 7-046608

[51] Int. Cl.[7] ..... B41J 2/01

[52] U.S. Cl. ..... 347/101; 347/100

[58] Field of Search ..... 347/101, 100, 347/96, 98

[56] References Cited

U.S. PATENT DOCUMENTS

| | | | |
|---|---|---|---|
| 4,150,997 | 4/1979 | Hayes . | |
| 4,538,160 | 8/1985 | Uchiyama | 347/101 |
| 4,694,302 | 9/1987 | Hackleman et al. . | |
| 4,713,746 | 12/1987 | Watanabe | 347/15 |
| 4,746,935 | 5/1988 | Allen | 347/98 |
| 5,062,893 | 11/1991 | Adamic et al. . | |
| 5,172,139 | 12/1992 | Sekiya et al. | 347/15 |
| 5,181,045 | 1/1993 | Shields et al. . | |
| 5,380,358 | 1/1995 | Aoki et al. . | |
| 5,549,740 | 8/1996 | Takahashi | 347/101 X |
| 5,614,007 | 3/1997 | Kurabayashi et al. . | |
| 5,623,294 | 4/1997 | Takizawa | 347/98 |
| 5,635,969 | 6/1997 | Allen | 347/96 |
| 5,640,187 | 6/1997 | Kashiwazaki et al. | 347/101 |
| 5,700,314 | 12/1997 | Kurbayashi et al. . | |
| 5,792,249 | 8/1998 | Shirota et al. | 106/31.27 |
| 5,835,116 | 11/1998 | Sato et al. | 347/98 |

FOREIGN PATENT DOCUMENTS

| | | |
|---|---|---|
| 0 224 909 | 6/1987 | European Pat. Off. . |
| 0 363 139 | 4/1990 | European Pat. Off. . |

(List continued on next page.)

*Primary Examiner*—Richard Moses
*Attorney, Agent, or Firm*—Fitzpatrick, Cella, Harper & Scinto

[57] ABSTRACT

Disclosed herein is an ink-jet recording process for forming an image by applying an ink to a recording medium in accordance with an ink-jet recording system, comprising the steps of:

(A) applying an ink containing a coloring material to the recording medium in accordance with the ink-jet recording system; and (B) applying a liquid composition different from the ink to an ink-applying region of the recording medium in accordance with the ink-jet recording system, wherein the liquid composition is applied in an amount less than 50% by volume of the amount of the ink to be applied to the ink-applying area.

33 Claims, 3 Drawing Sheets

FOREIGN PATENT DOCUMENTS

| | | | |
|---|---|---|---|
| 0 472 196 | 2/1992 | European Pat. Off. . | |
| 0 487 349 | 5/1992 | European Pat. Off. . | |
| 0 507 239 | 10/1992 | European Pat. Off. . | |
| 0 534 634 | 3/1993 | European Pat. Off. | B41M 5/00 |
| 0 587 164 | 3/1994 | European Pat. Off. | B41M 1/30 |
| 0 588 316 | 3/1994 | European Pat. Off. . | |
| 0 596 373 | 5/1994 | European Pat. Off. . | |
| 0 633 142 | 1/1995 | European Pat. Off. | B41M 5/00 |
| 0 661 168 | 7/1995 | European Pat. Off. . | |
| 0 675 178 | 10/1995 | European Pat. Off. . | |
| 0 697 445 | 2/1996 | European Pat. Off. | C09D 11/00 |
| 53-24486 | 3/1978 | Japan | D06P 5/08 |
| 54-43733 | 4/1979 | Japan | B41J 3/04 |
| 55-150396 | 11/1980 | Japan | B41M 5/00 |
| 56-99693 | 8/1981 | Japan . | |
| 58-89667 | 5/1983 | Japan . | |
| 58-128862 | 8/1983 | Japan | B41J 3/04 |
| 58-225171 | 12/1983 | Japan . | |
| 61-32757 | 2/1986 | Japan | B41J 3/04 |
| 61-172787 | 8/1986 | Japan . | |
| 63-42872 | 2/1988 | Japan | B41J 3/04 |
| 63-60783 | 3/1988 | Japan | B41M 5/00 |
| 63-281885 | 11/1988 | Japan . | |
| 363299971 | 12/1988 | Japan | B41M 5/00 |
| 63-299971 | 12/1988 | Japan | B41M 5/00 |
| 401069381 | 3/1989 | Japan | B41M 5/00 |
| 64-69381 | 3/1989 | Japan | B41M 5/00 |
| 406099576 | 4/1994 | Japan | B41J 2/01 |
| 6-107988 | 4/1994 | Japan . | |
| 2 088 777 | 6/1982 | United Kingdom . | |

INK-JET RECORDING PROCESS, INK-JET RECORDING APPARATUS AND IMAGE FORMED ARTICLE

BACKGROUND OF THE INVENTION

1. Field of the Invention

The present invention relates to an ink-jet recording process and an ink-jet recording apparatus, which permits the formation of high-quality images excellent in water fastness without impairing fixing ability on various recording media such as paper, cloths, resin films, leather and metals, and an image formed article obtained by using the process and apparatus.

2. Related Background Art

An ink-jet recording system has heretofore been widely used in printers, copying machines and the like because of slight noise, low running cost, possible high-speed recording, easy miniaturization of apparatus, easy color recording and the like. However, the ink-jet recording system has involved problems that when images are formed on recoding media referred to as the so-called plain paper by these recording apparatuser to which the ink-jet recording system is applied, the resulting images are insufficient in water fastness, and that when color images are provided, it is difficult to achieve, in particular, the formation of high-density images free of feathering and the formation of images free of bleeding between different colors at the same time, and so color images having good fastness properties and image quality cannot be obtained.

To cope with these problems, in recent years, inks in which water fastness has been imparted to a coloring material contained therein have come to be put to practical use as a method for enhancing the water fastness of the resulting images. However, these inks have involved the following demerits. Their water fastness is not yet sufficient, and moreover these inks tend to cause clogging at orifices of a recording head because they are difficult in principle to be dissolved in water after drying. The prevention of such clogging results in the complicated construction of the apparatus.

Many techniques for improving the fastness properties of recorded images have heretofore been disclosed. For example, Japanese Patent Application Laid-Open No. 53-24486 discloses a technique for enhancing the wet color fastness in which dyed matter is subjected to a post treatment, thereby fixing dyes in the form of lake.

Japanese Patent Application Laid-Open No. 54-43733 discloses a recording method using an ink-jet recording system, wherein at least two components, the film-forming ability of which is increased when they are brought into contact with each other, are used. According to this method, printed matter, on which a film firmly bonded has been formed by bringing the components into contact with each other on a recording medium, is obtained. Japanese Patent Application Laid-Open No. 55-150396 also discloses a process of applying a water-proofing agent which can form lake with a dye after conducting ink-jet recording using a water-based dye ink.

Japanese Patent Application Laid-Open No. 58-128862 discloses an ink-jet recording process in which a position of an image to be recorded is identified in advance, and a recording ink and a treating ink are applied to the position to overlap each other, thereby conducting recording. A process in which the treating ink is applied prior to the application of the recording ink, a process in which the treating ink is applied to overlap the recording ink applied previously, and a process in which the recording ink is applied to overlap the treating ink applied previously, and the treating ink is further applied to overlap the recording ink are disclosed. Japanese Patent Application Laid-Open Nos. 63-60783 and 64-69381 also disclose similar recording processes.

However, according to these processes, the color of the recorded images may be changed by the treating ink to a hue with a metallic luster like a crystallized dye, which is called "bronzing phenomenon". Such a phenomenon may become a problem in some cases. In addition, a problem of evenness may also arise upon solid printing in some cases.

The documents described above do not disclose anything about the optimum ratio between the amounts of the treating ink and the recording ink to be ejected. None of them disclose anything about the construction of a recording head characteristic of an ink-jet recording apparatus, print mode required to enhance the quality of recorded images, and the like.

SUMMARY OF THE INVENTION

It is therefore an object of the present invention to provide an ink-jet recording process and an ink-jet recording apparatus, which can solve the above-described problems involved in the prior art and form high-quality images excellent in water fastness.

Another object of the present invention is to provide an ink-jet recording process and an ink-jet recording apparatus, which can prevent the occurrence of the bronzing phenomenon and form high-quality images excellent in evenness of solid printed areas.

A further object of the present invention is to provide an ink-jet recording process and an ink-jet recording apparatus, by which curling and cockling occur only to a very slight extent, and high-quality images having high water fastness can be formed.

A still further object of the present invention is to provide an image formed article which has high-quality images free of bronzing and excellent in evenness of solid printed areas, and scarcely undergoes curling and cockling.

The above objects can be achieved by the present invention described below.

According to the present invention, there is thus provided an ink-jet recording process for forming an image by applying an ink to a recording medium in accordance with an ink-jet recording system, comprising the steps of:

(A) applying an ink containing a coloring material to the recording medium, in accordance with the ink-jet recording system; and (B) applying a liquid composition different from the ink to an ink-applying region of the recording medium, in accordance with the ink-jet recording system, wherein the liquid composition is applied in an amount less than 50% by volume of the amount of the ink to be applied to the ink-applying region.

According to the present invention, there is also provided an ink-jet recording apparatus for forming an image by ejecting an ink containing a coloring material from an ink-ejecting part to apply to a recording medium, and ejecting a liquid composition different from the ink from a liquid composition-ejecting part to apply to the recording medium, comprising:

ejection-control means for controlling the ejection of the ink from the ink-ejecting part and the ejection of the liquid composition from the liquid composition-ejecting part, wherein the ejection-control means serves to apply the liquid composition to an ink-applying region of the recording medium, and the liquid composition is applied in an amount less than 50% by volume of the amount of the ink to be applied to the ink-applying region.

According to the present invention, there is further provided an image formed article comprising:

a recording medium; and an image formed on the recording medium, wherein the image is formed by performing, in accordance with an ink-jet recording system, a step (A) of applying an ink containing a coloring material to the recording medium; and a step (B) of applying a liquid composition different from the ink to an ink-applying region of the recording medium, in order of (A) and (B), or (B) and (A), and the liquid composition is applied in an amount less than 50% by volume of the amount of the ink to be applied to the ink-applying region.

DESCRIPTION OF THE PREFERRED EMBODIMENTS

Figure 1:
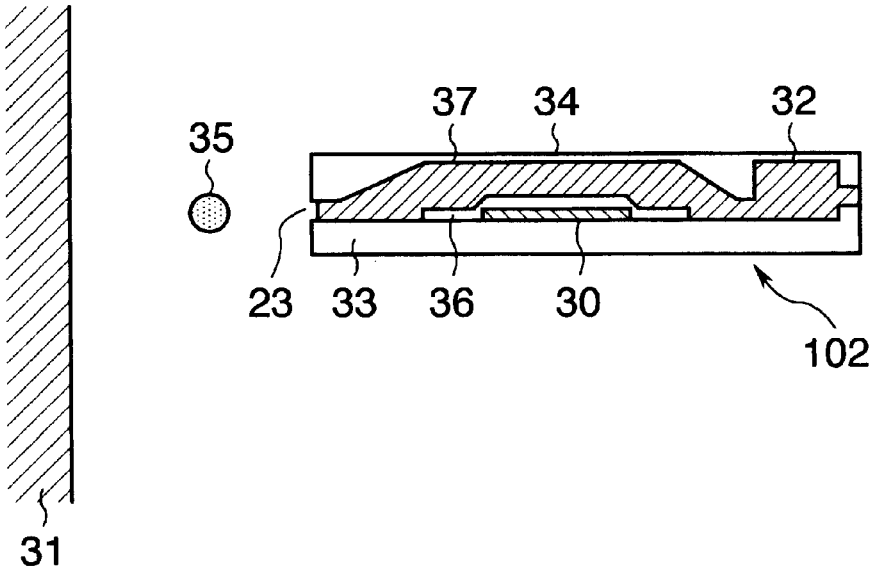
FIG. 1 is an enlarged cross-sectional view of a recording head.

The present invention will now be described in more detail by the preferred embodiments.

In a first embodiment of the present invention, an ink-jet recording process for forming an image by applying an ink to a recording medium in accordance with an ink-jet recording system, comprises the steps of (A) applying an ink containing a coloring material to the recording medium in accordance with the ink-jet recording system, and (B) applying a liquid composition different from the ink to an ink-applying region of the recording medium in accordance with the ink-jet recording system, wherein the liquid composition is applied in an amount less than 50% by volume of the amount of the ink to be applied to the ink-applying region.

According to such an embodiment, the bronzing phenomenon is prevented, and high-quality images excellent in evenness of solid printed areas can be formed. In addition, curling and cockling which occur on the recording medium after the formation of the images can be lessened with the reduction of the liquid composition.

In a second embodiment of the present invention according to the same ink-jet recording process as in the first embodiment, the liquid composition is applied in an amount not less than 25% by volume but less than 50% by volume of the amount of the ink to be applied to the ink-applying region.

According to such an embodiment, the bronzing phenomenon is prevented, and high-quality images excellent in evenness of solid printed areas and high in water fastness can be formed. In addition, as with the first embodiment, curling and cockling which occur on the recording medium after the formation of the images can be lessened with the reduction of the liquid composition.

In a third embodiment of the present invention according to the same ink-jet recording process as in the first embodiment, the liquid composition is applied in an amount not less than 25% by volume but not more than 45% by volume of the amount of the ink to be applied to the ink-applying region.

According to such an embodiment, the same effects as in the second embodiment can also be achieved. In particular, curling and cockling which occur on the recording medium after the formation of the images can be lessened with reliability by this embodiment.

The liquid composition useful in the practice of the present invention will next be described.

The liquid composition used in the present invention may be any liquid composition so far as it exhibits, in general recording of images, the following attributes:

(1) the water fastness of the resulting recorded images is improved; and (2) the print quality of the resulting recorded images is improved, and has, in color recording, the following attribute in addition to the above-described two attributes:

(3) bleeding at boundaries between different colors is lessened.

Accordingly, as the liquid composition used in the present invention, any conventionally known liquid composition may be used so far as it has the above-described attributes. However, a liquid composition containing at least one cationic substance is particularly preferred from the viewpoint of exhibiting the above-described effects.

No particular limitation is imposed on the cationic substance contained in this composition so far as it has a cationic group in its molecule. However, preferable examples thereof include cationic surfactants, and cationic oligomers and polymers.

Examples of the cationic surfactants include compounds of the primary, secondary and tertiary amine salt types, specifically, the hydrochlorides of laurylamine, coconut amine, stearylamine, rosin amine and the like; compounds of the quaternary ammonium salt type, specifically, cetyltrimethylammonium chloride, lauryltrimethylammonium chloride, lauryldimethylbenzyl-ammonium chloride, benzyltributylammonium chloride, benzalkonium chloride and the like; and aqueous solutions of amphoteric surfactants exhibiting cationic properties in a certain pH region, for example, amino acid type amphoteric surfactants and betaine type compounds, which the solutions have a pH not higher than their isoelectric point. It goes without saying that cationic compounds usable in the present invention are not limited to these compounds. Among these compounds, the compounds of the quaternary ammonium salt type are particularly preferred.

Examples of the cationic oligomers and polymers include oligomers, homopolymers and copolymers of cationic monomers such as vinylamine, allylamine, vinylpyridine, vinylimidazole, N,N-dimethylaminoacrylamide, ethyleneimine and 2-oxazoline. However, such oligomers and polymers are not limited to those obtained by using these monomers. Copolymers of the above-mentioned cationic monomers with other monomers, for example, nonionic monomers may also be used. In addition, those obtained by partially cationizing nonionic oligomers and polymers may also be used.

Of these, oligomers and polymers comprising allylamine as a structural element are particularly preferred. The combined use of the low-molecular weight cationic surfactant with the polyallylamine permits the reduction of bleeding at boundaries between different colors when conducting color recording. Therefore, among the above-described substances, such combination is particularly preferred for use in color recording.

The liquid composition used in the present invention is prepared by incorporating the cationic substance, water, a water-soluble organic solvent inert to the cationic substance, and optional other components, for example, viscosity modifiers, pH adjustors, mildew proofing agents, antioxidants, etc. The amount of the cationic substance to be contained and used in the liquid composition is within a range of from 0.05 to 20% by weight, preferably from 0.5 to 5% by weight based on the total weight of the liquid composition.

Inks used in the present invention, comprising a liquid medium and a coloring material use, as the coloring material, a water-soluble dye, particularly, a dye containing an anionic group as a solubilizing group. The liquid medium comprises water and various water-soluble organic solvents. Further, to the inks, other components, for example, viscosity modifiers, pH adjustors, mildew proofing agents, non-ionic and anionic surfactants, and antioxidants may be suitably added as needed.

No particular limitation is imposed on the water-soluble dye containing an anionic group so far as it is a water-soluble acid dye, direct dye or reactive dye, which is described in COLOR INDEX. Any dye not described in COLOR INDEX may also be used without any particular limitation so far as it has an anionic group, for example, a sulfonic group or carboxylic group. Among these water-soluble dyes used herein, those having dependence of solubility on pH may also be included as a matter of course. These dyes are used in an amount ranging from 1 to 10% by weight, preferably from 1 to 5% by weight based on the total weight of the ink.

In the present invention, the coloring materials are not limited to the dyes, and inks containing a pigment as a coloring material may also be used.

A method of applying the ink and the liquid composition as described above to a recording medium will be described. In the present invention, an ink-jet recording method and apparatus, by which the amounts of the ink and the liquid composition to be applied to the recording medium can be suitably controlled, is required. As an ink-jet recording apparatus used in the present invention, an apparatus having a system, in which thermal energy is applied to the ink and the liquid composition from respective heating elements provided in a recording head to eject their droplets, thereby applying the droplets to the recording medium to form an image, is preferred.

When such an ink-jet recording apparatus is used, it is preferred that control of the amounts of the ink and the liquid composition to be applied to the recording medium in an image-forming region be conducted by constructing the recording head in such a manner that the heating values of the heating elements provided in the recording head can be regulated.

Figure 2:
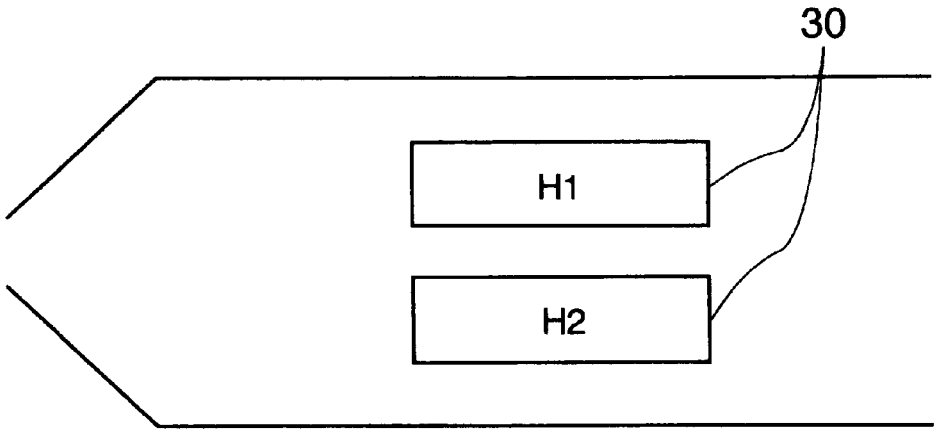
FIG. 2 is an enlarged elevational view of another recording head.

In order to regulate the heating value of the heating element, it is only necessary to change a pulse length applied to the heating element in a recording head constructing the recording head of an ink-jet recording apparatus, or to provide a plurality of heating elements, the areas of which have been varied, so as to selectively use them for the ink or the liquid composition. When, as an alternative method, at least two heating elements, which can independently generate heat, are provided in all nozzles of the recording head as illustrated in FIG. 2 (in FIG. 2, two heating elements are shown) to suitably select the number of the heating elements, to which energy is applied so as to generate heat, according to the process of recording, it is possible to freely change the amount of the ink or liquid composition to be ejected from each nozzle. When the heating elements are constructed in the above-described manner, the amounts of the ink and the liquid composition to be ejected can be separately changed while the same recording heads are used for the ink and the liquid composition, whereby the recording heads can be made common to the ink and the liquid composition. Therefore, such construction is particularly preferred.

FIG. 1 is an enlarged cross-sectional view illustrating an electrothermal converter and the periphery thereof in a recording head 102 of such an ink-jet recording apparatus as described above.

In FIG. 1, reference numeral 30 designates a heating element. The heating element 30 is an electrothermal converter for the recording head and is provided in each nozzle in such a construction that it can independently generate heat. In an ink in a nozzle, which has been quickly heated by the heat generated by such a heating element 30, bubbles are formed by film boiling. As illustrated in FIG. 1, an ink droplet 35 is ejected toward a recording medium 31 by the pressure generated by the formation of the bubbles to form-a character or image on the recording medium. The volume of the ink droplet ejected at this time is generally from 10 to 100 pl.

Each of ejection orifices 23 is provided with an ink flow path 37 communicating with the ejection orifice. A common liquid chamber 32 for supplying the ink to the individual ink flow paths 37 is provided rearward of the region in which the ink flow paths 37 have been defined. A heating element 30, which is an electrothermal converter serving to generate thermal energy used for ejecting the ink droplet from the ejection orifice, and an electrode wiring for supplying electric power to the heating element 30 are provided in the ink flow path 37 corresponding to each ejection orifice 23. These heating elements 30 and electrode wirings are formed on a substrate 33 such as silicon by a film-forming technique. On the heating element 30, a protective film 36 is formed in order for the ink not to come into direct contact with the heating element. Further, a partition wall formed of a resin or glass is laminated on the substrate 33, whereby the ejection orifices 23, ink flow paths 37, common liquid chamber 32 and the like are constructed.

The recording system using the electrothermal converter is called a bubble-jet recording system as a popular name because bubbles formed by the application of thermal energy are used for the ejection of the ink droplet 35.

FIG. 2 is an enlarged elevational view illustrating electrothermal converters and the periphery thereof in a bubble-jet recording head, which can change the amount of the ink to be ejected. In this drawing, as heating elements 30, which are the electrothermal converters in the recording head, two heating elements, H1 and H2, are provided in each nozzle in such a manner that they can independently generate heat.

In the recording head constructed in this manner, the recording head is controlled in such a manner that the heating elements H1 and H2 corresponding to the ejection orifice of each nozzle generate heat at the same time when recording is conducted in a large-ejection quantity. On the other hand, the recording head is controlled in such a manner that only the heating element H1 or H2 in each nozzle generates heat when recording is conducted a small-ejection quantity. In this case, the amount of each color ink ejected becomes less than when recording is conducted in the large-ejection quantity. According to such a recording head system as the amount of the ink to be ejected is changed according to the process of recording, the effects of the present invention are exhibited to a more marked extent as will be described subsequently in Experimental Examples.

The ink-jet recording process according to the present invention is characterized by comprising the steps of (A) applying an ink to an image-forming region on a recording medium by the ink-jet recording method of the above-described system and (B) applying a liquid composition to the image-forming region of the ink on the recording medium.

No particular limitation is imposed on the order of the step (B) of applying the liquid composition and the step (A) of applying the ink. For example, in the case where the liquid composition is first applied to the recording medium, no particular limitation is also imposed on the time interval to which the ink is subsequently applied to the recording medium. It is however preferable to apply the ink to the recording medium at almost the same time or within several seconds.

Although the application of the ink may be performed at once by one nozzle, the ink for one pixel may be applied in portions by plural nozzles and recording operations. More specifically, a part of the ink is first applied to the recording medium, and the liquid composition is then applied to the image-forming region. Thereafter, the remaining ink is applied, thereby conducting recording by the plural operations. This recording method is preferred from the viewpoint of improvement in the fixing ability of the ink and print quality. In this case, therefore, an ink-jet recording process, in which the step (A) is first performed, the step (B) is then carried out, and thereafter, the step (A) is further performed, is used.

No particular limitation is imposed on the recording medium used in the above-described ink-jet recording process, and the so-called plain paper such as paper for copying and bond paper, which are routinely used, are preferably used. It goes without saying that coated paper specially prepared for ink-jet recording, and transparent films for OHP may also be suitably used, and besides general-purpose woodfree paper and glossy paper may also be suitably used.

It goes without saying that the present invention can be used in not only the formation of single-color images, but also the formation of multi-color images.

The present invention will hereinafter be described more specifically by the following Experimental Examples. Incidentally, all designations of "part" or "parts" and "%" as will be used in the following examples mean part or parts by weight and % by weight unless expressly noted. In the following Experimental Examples, peaks of the molecular weight distribution as to cationic substances were determined by the GPC process using polyethylene oxide as a standard.

Experimental Examples 1 to 21

The following respective components for a black ink and liquid compositions were mixed and thoroughly stirred, and the resultant mixtures were then filtered under pressure through a Fluoropore Filter (trade name; product of Sumitomo Electric Industries, Ltd.) having a pore size of 0.22 $\mu$m, thereby providing a black ink and liquid compositions for use in the present invention. The polyallylamine used was synthesized in accordance with the method described in "Kino Zairyo (Functional Materials)", Vol. 5, 29 (1985).

| | |
|---|---|
| [Black (Bk) ink] | |
| Glycerol | 5.0% |
| Thiodiglycol | 5.0% |
| Urea | 5.0% |
| Isopropyl alcohol | 4.0% |
| Dye, C.I. Food Black 2 | 2.0% |
| Water | 79.0%. |
| [Liquid composition A] | |
| Polyallylamine hydrochloride (synthesized in our company, peak of molecular weight distribution: 800) | 5.0% |
| Benzalkonium chloride (Cation G50, trade name, product of Sanyo Chemical Industries, Ltd.) | 1.0% |
| Diethylene glycol | 10.0% |
| Water | 84.0%. |
| [Liquid composition B] | |
| Polyethyleneimine hydrochloride (Epomine SP-012, trade name, product of Nippon Shokubai Kaqaku Kogyo Co., Ltd., peak of molecular weight distribution: 1,200) | 5.0% |
| Cetyltrimethylammonium chloride (LEBON TM-16, trade name, product of Sanyo Chemical Industries, Ltd.) | 1.0% |
| Diethylene glycol | 10.0% |
| Water | 84.0%. |
| [Liquid composition C] | |
| Polyaminesulfone hydrochloride (PAS-A-5, trade name, product of Nitto Boseki Co., Ltd., peak of molecular weight distribution: 3,500) | 5.0% |
| Benzalkonium chloride (Cation G50, trade name, product of Sanyo Chemical Industries, Ltd.) | 1.0% |
| Diethylene glycol | 10.0% |
| Water | 84.0%. |

Incidentally, an instance where a dye is used as a coloring material for the Bk ink has been described herein. The present invention is however not limited to this dye, and, for example, a pigment may also be used as a coloring material either singly or in combination with a dye.

The thus-obtained Bk ink and liquid compositions A to C were used to form images under their corresponding ejection conditions shown in Table 1, and the resultant image samples were evaluated. Incidentally, the liquid composition A, liquid composition B and liquid composition C were used in Experimental Examples 1 to 7, Experimental Examples 8 to 14 and Experimental Examples 15 to 21, respectively.

The ink and the liquid composition were charged in an ink-jet printer (resolution: 360 dpi) in which thermal energy is applied to the ink in a recording head to generate droplets, thereby making a record on commercially available paper for copying, bond paper and regenerated paper to form the images.

Figure 3:
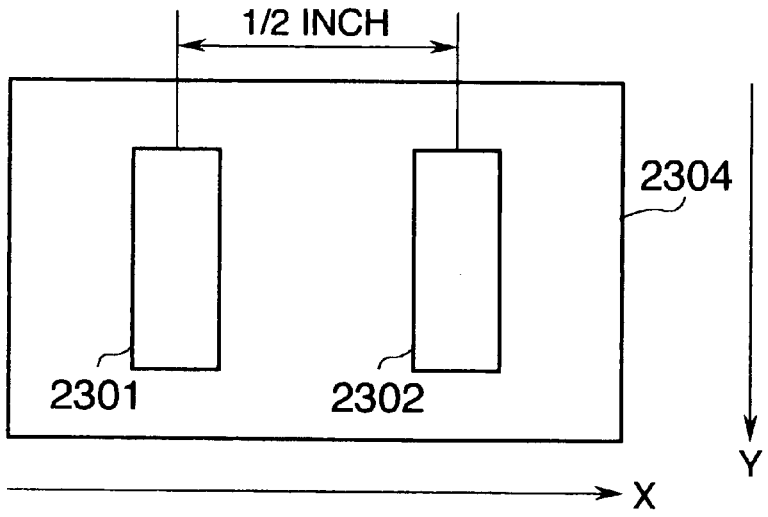
FIG. 3 illustrates a recording head unit.

The construction of a recording head unit of a recording apparatus used at this time comprises an S chip 2301 (for a liquid composition) and a Bk chip 2302 as illustrated in FIG. 3. The individual chips are arranged on a frame 2304 in an inclined relation with them compensating by timing of drive at a pitch of ½ inch. The number of nozzles in each chip is 64, and a nozzle line in each chip is arranged so as to intersect almost perpendicularly to the direction of an arrow X. The pitch of each nozzle is about 70 $\mu$m, and the use of such a head permits the recording of a band of 64 nozzles with resolution of 360 dpi by one main scanning.

As the individual chips used in Experimental Examples 1 to 21, those separately having heating elements with heating values according to the amounts of the liquid composition and Bk ink to be ejected were provided and used in combination. The minute regulation of the ejection quantities was carried out by changing a pulse length to be applied.

TABLE 1

| | Ejection conditions | | | |
|---|---|---|---|---|
| Exptl Ex. | Amount of Bk ink ejected (pl) | Liquid Comp. | Amount of liquid comp. ejected (pl) | Ratio of ejected amounts of liquid comp. to Bk ink (%) |
| 1 | 80 | A | 72 | 90 |
| 2 | 80 | A | 60 | 75 |
| 3 | 80 | A | 40 | 50 |
| 4 | 80 | A | 36 | 45 |
| 5 | 80 | A | 28 | 35 |
| 6 | 80 | A | 20 | 25 |
| 7 | 80 | A | 8 | 10 |
| 8 | 80 | B | 72 | 90 |
| 9 | 80 | B | 60 | 75 |
| 10 | 80 | B | 40 | 50 |
| 11 | 80 | B | 36 | 45 |
| 12 | 80 | B | 28 | 35 |
| 13 | 80 | B | 20 | 25 |
| 14 | 80 | B | 8 | 10 |
| 15 | 80 | C | 72 | 90 |
| 16 | 80 | C | 60 | 75 |
| 17 | 80 | C | 40 | 50 |
| 18 | 80 | C | 36 | 45 |
| 19 | 80 | C | 28 | 35 |
| 20 | 80 | C | 20 | 25 |
| 21 | 80 | C | 8 | 10 |

<Evaluation>

The recorded image samples obtained above were evaluated as to the following various items in accordance with the following evaluation methods and standards. The results of the evaluation are shown in Table 2.

(1) Image Density:

After a solid print was formed with the combination of the liquid composition and the black ink in each set and air-dried in a room for 12 hours, its reflection density was measured by Macbeth RD915 (manufactured by Macbeth Company) and ranked in accordance with the following standard:

A: Reflection densities for all kinds of paper were not lower than 1.35;

B: Reflection densities for some kinds of paper were not lower than 1.3 but lower than 1.35;

C: Reflection densities for some kinds of paper were not lower than 1.2 but lower than 1.3; and D: Reflection densities for some kinds of paper were lower than 1.2.

(2) Print Quality:

English characters and numerals were printed with the combination of the liquid composition and the black ink in each set, and the resultant print sample was visually evaluated as to the print quality to rank in accordance with the following standard:

A: No feathering occurred on all kinds of paper;

B: Small feathering occurred compared with Rank A, but problems scarcely arose;

C: Feathering somewhat occurred on some kinds of paper, but no problems arose from the viewpoint of practical use;

D: Feathering conspicuously occurred on some kinds of paper, and problems arose from the viewpoint of practical use;

E: Feathering conspicuously occurred on all kinds of paper, and problems arose from the viewpoint of practical use.

(3) Water Fastness:

After a solid print and English characters and numerals were printed with the combination of the liquid composition and the black ink in each set, and the resulting print samples were left over for 1 hour, they were immersed for 10 seconds in tap water of 20° C. Thereafter, they were taken out of the water and air-dried as they are and visually evaluated as to water fastness to rank in accordance with the following standard:

A: No running of the coloring material toward the blank portion of the recording medium occurred, greasing was scarcely recognized, and blurring of the English characters and numerals also scarcely occurred;

B: Running of the coloring material toward the blank portion of the recording medium and greasing scarcely occurred, and blurring of the English characters and numerals somewhat occurred, but no problems arose from the viewpoint of practical use;

C: Running of the coloring material toward the blank portion of the recording medium and greasing scarcely occurred, but blurring of the English characters and numerals occurred and problems arose from the viewpoint of practical use.

(4) Resistance to Bronzing:

After a solid print was formed with the combination of the liquid composition and the black ink in each set and air-dried in a room for 12 hours, the color tone of the resultant print sample was visually evaluated to rank the resistance to bronzing in accordance with the following standard:

A: No bronzing occurred;

B: The print sample seemed to somewhat bronze, but no problems arose from the viewpoint of practical use;

C: Bronzing conspicuously occurred, and problems arose from the viewpoint of practical use.

(5) Evenness of Solid Print:

After a solid print was formed with the combination of the liquid composition and the black ink in each set and air-dried in a room for 12 hours, the evenness of the resultant solid print was visually evaluated and ranked in accordance with the following standard:

A: The solid print was even, and no problems arose;

B: The solid print seemed to be somewhat uneven, but no problems arose from the viewpoint of practical use;

C: Unevenness of the solid print was conspicuous, and problems arose from the viewpoint of practical use.

(6) Resistance to Cockling:

An image with 100% duty (full solid of Bk ink) was printed on each recording paper with the combination of the liquid composition and the black ink in each set and visually observed to rank the resistance to cockling as C where surface waviness occurred to a significant extent from right after the printing and did not vanish even upon elapsed time of 12 hours after the printing, B where surface waviness somewhat occurred from right after the printing but vanished upon elapsed time of 12 hours after the printing, and no problems arose from the viewpoint of practical use, or A where surface waviness scarcely occurred from right after the printing.

(7) Resistance to Curling:

The same pattern as that formed in the evaluation as to the resistance to cockling was printed and observed upon elapsed time of 12 hours after the printing to rank the resistance to curling as C where curling occurred to such a significant extent that both ends of the recording medium curled inward, B where curling slightly occurred, but no problems arose from the viewpoint of practical use, or A where curling scarcely occurred.

TABLE 2

| Experimental Example | Evaluation results: Evaluated item (1) | (2) | (3) | (4) | (5) | (6) | (7) |
|---|---|---|---|---|---|---|---|
| 1 | A | B | A | B | B | B | B |
| 2 | A | B | A | A | A | B | B |
| 3 | A | B | A | A | A | B | B |
| 4 | A | B | A | A | A | B | A |
| 5 | A | B | A | A | A | A | A |
| 6 | A | B | A | A | A | A | A |
| 7 | A | B | B | A | A | A | A |
| 8 | A | C | A | B | B | B | B |
| 9 | A | C | A | A | A | B | B |
| 10 | A | C | A | A | A | B | B |
| 11 | A | C | A | A | A | B | A |
| 12 | A | C | A | A | A | A | A |
| 13 | A | C | A | A | A | A | A |
| 14 | A | C | B | A | A | A | A |
| 15 | A | C | A | B | B | B | B |
| 16 | A | C | A | A | A | B | B |
| 17 | A | C | A | A | A | B | B |
| 18 | A | C | A | A | A | B | A |
| 19 | A | C | A | A | A | A | A |
| 20 | A | C | A | A | A | A | A |
| 21 | A | C | B | A | A | A | A |

(Note): (1): Image density. (2): Print quality. (3): Water fastness. (4): Resistance to bronzinq. (5): Evenness of solid print. (6): Resistance to cockling. (7): Resistance to curling.

Experimental Examples 22 to 42

Figure 4:
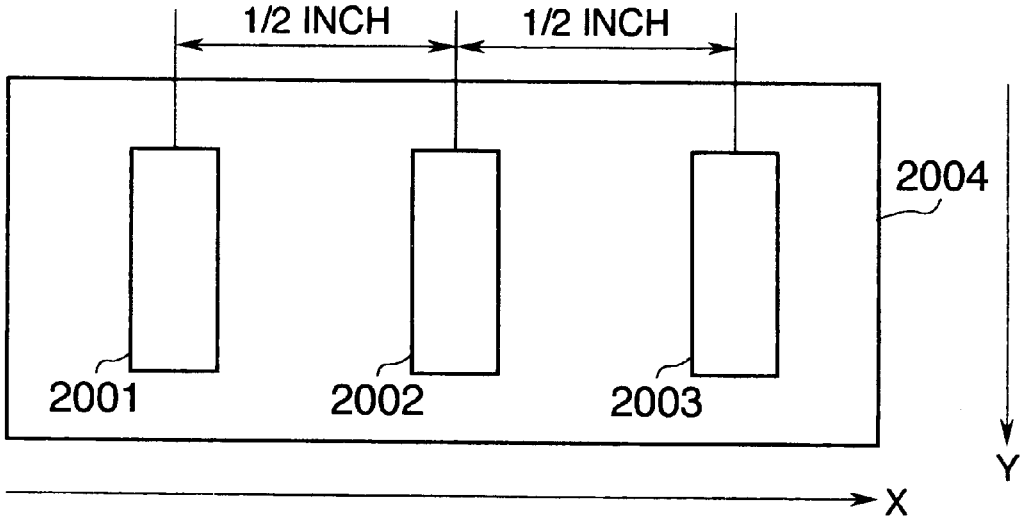
FIG. 4 illustrates another recording head unit.

The construction of a recording head unit of a recording apparatus used in Experimental Examples 22 to 42 comprises a Bk1 chip 2001, an S chip 2002 and a Bk2 chip 2003 as illustrated in FIG. 4. The individual chips are arranged on a frame 2004 in an inclined relation with them compensating by timing of drive at a pitch of ½ inch. The number of nozzles in each chip is 64, and a nozzle line in each chip is arranged so as to intersect almost perpendicularly to the direction of an arrow X. The pitch of each nozzle is about 70 μm, and the use of such a head permits the recording of a band of 64 nozzles with resolution of 360 dpi by one main scanning. In these experimental examples, the application of the ink was conducted in two installments of 40 pl by means of two nozzle chips, Bk1 chip 2001 and Bk2 chip 2003.

As the individual chips used in Experimental Examples 22 to 42, those separately having heating elements with heating values according to the amounts of a liquid composition and a Bk ink to be ejected were used in combination. In Experimental Examples 22 to 42, the same Bk ink and liquid composition as those used in Experimental Examples 1 to 21 were used. The ejection conditions of the Bk ink and the liquid compositions used in Experimental Examples 22 to 42 are shown in Table 3. The resulting recorded image samples were evaluated in the same manner as in Experimental Examples 1 to 21. The results of the evaluation are shown in Table 4.

TABLE 3

| Exptl Ex. | Ejection conditions: Amount of Bk ink ejected (pl) | Amount of Bk ink applied (pl) | Liquid Comp. | Amount of liquid comp. ejected (pl) | Ratio of ejected amounts of liquid comp. to Bk ink (%) |
|---|---|---|---|---|---|
| 22 | 40 | 80 | A | 72 | 90 |
| 23 | 40 | 80 | A | 60 | 75 |
| 24 | 40 | 80 | A | 40 | 50 |
| 25 | 40 | 80 | A | 36 | 45 |
| 26 | 40 | 80 | A | 28 | 35 |
| 27 | 40 | 80 | A | 20 | 25 |
| 28 | 40 | 80 | A | 8 | 10 |
| 29 | 40 | 80 | B | 72 | 90 |
| 30 | 40 | 80 | B | 60 | 75 |
| 31 | 40 | 80 | B | 40 | 50 |
| 32 | 40 | 80 | B | 36 | 45 |
| 33 | 40 | 80 | B | 28 | 35 |
| 34 | 40 | 80 | B | 20 | 25 |
| 35 | 40 | 80 | B | 8 | 10 |
| 36 | 40 | 80 | C | 72 | 90 |
| 37 | 40 | 80 | C | 60 | 75 |
| 38 | 40 | 80 | C | 40 | 50 |
| 39 | 40 | 80 | C | 36 | 45 |
| 40 | 40 | 80 | C | 28 | 35 |
| 41 | 40 | 80 | C | 20 | 25 |
| 42 | 40 | 80 | C | 8 | 10 |

TABLE 4

| Experimental Example | Evaluation results: Evaluated item (1) | (2) | (3) | (4) | (5) | (6) | (7) |
|---|---|---|---|---|---|---|---|
| 22 | A | A | B | B | B | B | B |
| 23 | A | A | A | A | A | B | B |
| 24 | A | A | A | A | A | B | B |
| 25 | A | A | A | A | A | B | A |
| 26 | A | A | A | A | A | A | A |
| 27 | A | A | A | A | A | A | A |
| 28 | A | A | B | A | A | A | A |
| 29 | A | B | A | B | B | B | B |
| 30 | A | B | A | A | A | B | B |
| 31 | A | B | A | A | A | B | B |
| 32 | A | B | A | A | A | B | A |
| 33 | A | B | A | A | A | A | A |
| 34 | A | B | A | A | A | A | A |
| 35 | A | B | B | A | A | A | A |
| 36 | A | C | A | B | B | B | B |
| 37 | A | C | A | A | A | B | B |
| 38 | A | C | A | A | A | B | B |
| 39 | A | B | A | A | A | B | A |
| 40 | A | B | A | A | A | A | A |
| 41 | A | C | A | A | A | A | A |
| 42 | A | C | B | A | A | A | A |

(Note): (1): Image density. (2): Print quality. (3): Water fastness. (4): Resistance to bronzing. (5): Evenness of solid print. (6): Resistance to cockling. (7): Resistance to curling.

Experimental Example 43

In this experimental example, a recording head having two heating elements H1 and H2 in each nozzle as illustrated in FIG. 2 was used.

The construction of a recording head unit comprises an S chip 2301 and a Bk chip 2302 as illustrated in FIG. 3. The individual chips are arranged on a frame 2304 in an inclined relation with them compensating by timing of drive at a pitch of ½ inch. The number of nozzles in each chip is 64, and a nozzle line in each chip is arranged so as to intersect almost perpendicularly to the direction of an arrow X. The pitch of each nozzle is about 70 μm, and the use of such a head permits the recording of a band of 64 nozzles with resolution of 360 dpi by one main scanning. Incidentally, the Bk and S chips used in this experimental example were the same.

The amount of the ink or liquid composition ejected from the recording head used in this experimental example is about 25 pl where energy is applied only to the heating element H1, about 40 pl where energy is applied only to the heating element H2, and about 70 pl where energy is applied to both heating elements H1 and H2. The minute regulation of the ejection quantities was carried out by changing a pulse length further applied to the heating elements H1 and H2 to control energy applied to the heating elements. In this experimental example, recording was conducted while the recording head having such construction as described above was used to control the energy applied to the heating elements H1 and H2 in such a manner that the ejection quantities of the Bk ink and the liquid composition corresponded to those in Experimental Examples 1 to 6.

More specifically, the ejection quantity of the Bk ink was controlled by energizing both heating elements H1 and H2 so as to reach an ejection quantity of 80 pl in total, while the ejection quantity of the liquid composition was controlled by energizing only the heating element H1 or H2, or both H1 and H2 so as to reach an ejection quantity of 72, 60, 40, 36 28 or 20 pl. As a result, the resultant image samples obtained the same evaluation results as to the image density, print quality, water fastness, resistance to bronzing, evenness of solid print, resistance to cockling and resistance to curling as those in Experimental Examples 1 to 6.

Experimental Example 44

In this experimental example, a recording head having two heating elements H1 and H2 in each nozzle as illustrated in FIG. 2 was also used.

The construction of a recording head unit comprises a Bk1 chip 2001, an S chip 2002 and a Bk2 chip 2003 as illustrated in FIG. 4. The individual chips are arranged on a frame 2004 in an inclined relation with them compensating by timing of drive at a pitch of ½ inch. The Bk1, S and Bk2 chips used in this experimental example were the same.

As with the head used in Experimental Example 43, the amount of the ink or liquid composition ejected from the recording head is about 25 pl where energy is applied only to the heating element H1, about 40 pl where energy is applied only to the heating element H2, and about 70 pl where energy is applied to both heating elements H1 and H2. The minute regulation of the ejection quantities was carried out by changing a pulse length further applied to the heating elements H1 and H2 to control energy applied to the heating elements.

Recording was conducted by using this recording head to apply energy to the heating elements in such a manner that the ejection quantities of the Bk ink and the liquid composition corresponded to those in Experimental Examples 22 to 27. More specifically, the ejection quantity of the Bk ink was controlled by energizing only the heating element H2 so as to reach an ejection quantity of 40 pl, while the ejection quantity of the liquid composition was controlled by energizing only the heating element H1 or H2, or both H1 and H2 so as to reach an ejection quantity of 72, 60, 40, 36 28 or 20 pl. As a result, the resultant image samples were good in all the image density, print quality, water fastness, resistance to bronzing and evenness of solid print like those in Experimental Examples 22 to 27.

When the recording head is used as used in Experimental Examples 43 and 44, the liquid composition and the ink can be selectively applied to the recording medium in order of, for example, "liquid composition→ink" or "ink→liquid composition→ink" by suitably selecting the heating elements from which energy is generated. For example, it is possible to apply the ink and the liquid composition in order of "liquid composition→ink" in ordinary print mode or "ink→liquid composition→ink" in high-quality print mode.

Further, in this-case, the ejection quantities can be changed though all the chips are common to each other. Therefore, this process is also advantageous from the viewpoint of cost because chips for all colors can be made common.

Experimental Example 45 to 52

In these experimental examples, color recording was conducted with four inks of yellow (Y), magenta (M), cyan (C) and black (Bk) colors and liquid compositions.

The Bk ink used was the same ink as that used in Experimental Examples 1 to 44. As the Y, M and C inks, those having the following respective compositions were used. The individual color inks were prepared in the same manner as the Bk ink.

| | |
|---|---|
| [Yellow (Y) ink] | |
| Glycerol | 5.0% |
| Thiodiglycol | 5.0% |
| Urea | 5.0% |
| Isopropyl alcohol | 4.0% |
| Dye, C.I. Direct Yellow 142 | 2.0% |
| Water | 79.0%. |
| [Maqenta (M) ink] | |
| Glycerol | 5.0% |
| Thiodiglycol | 5.0% |
| Urea | 5.0% |
| Isopropyl alcohol | 4.0% |
| Dye, C.I. Acid Red 289 | 2.5% |
| Water | 78.5%. |
| [Cyan (C) ink] | |
| Glycerol | 5.0% |
| Thiodiglycol | 5.0% |
| Urea | 5.0% |
| Isopropyl alcohol | 4.0% |
| Dye, C.I. Direct Blue 199 | 2.5% |
| Water | 78.5%. |

As a liquid composition, a liquid composition D having the following composition was used in addition to the above-described liquid compositions A to C.

| [Liquid composition D] | |
|---|---|
| Polyallylamine hydrochloride (synthesized in our company, peak of molecular weight distribution: 800) | 5.0% |
| Diethylene glycol | 10.0% |
| Water | 85.0%. |

Incidentally, the liquid composition A, liquid composition B, liquid composition C and liquid composition D were used in Experimental Examples 45 to 46, Experimental Examples 47 to 48, Experimental Examples 49 to 50, and Experimental Examples 51 to 52, respectively.

The construction of a recording head unit used in these experimental examples comprises an S chip 2201, a Bk chip

Figure 5:
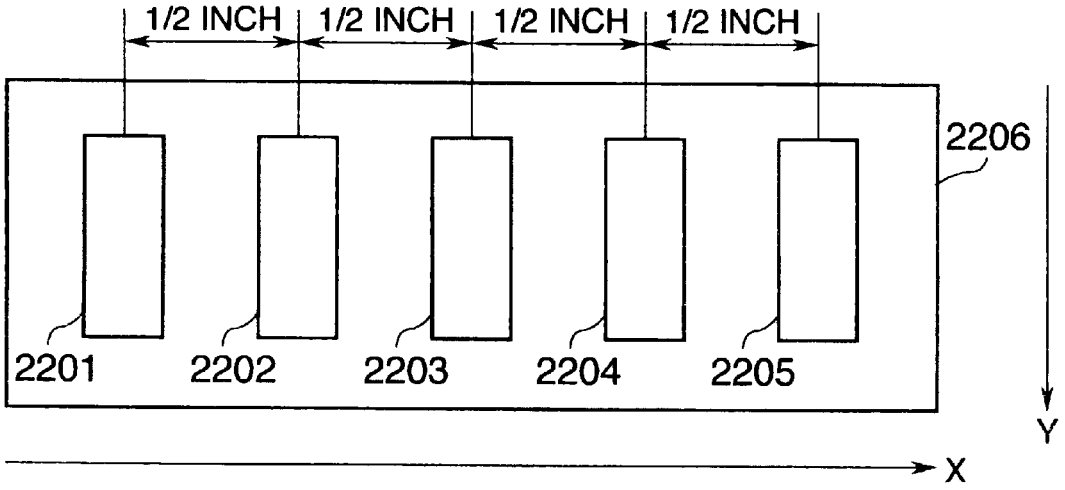
FIG. 5 illustrates a further recording head unit.

2202, a C (cyan) chip 2203, a M (magenta) chip 2204 and a Y (yellow) chip 2205 as illustrated in FIG. 5. The individual chips are arranged on a frame 2206 in an inclined relation with them compensating by timing of drive at a pitch of ½ inch. The number of nozzles in each chip is 64, and a nozzle line in each chip is arranged so as to intersect almost perpendicularly to the direction of an arrow X.

The pitch of each nozzle is about 70 μm, and the use of such a head permits the recording of a band of 64 nozzles with resolution of 360 dpi by one main scanning.

Heads having such respective heating elements as the ejection quantities of the liquid compositions become their corresponding amounts shown in Table 5, the ejection quantity of the Bk ink reaches 80 pl, and the ejection quantities of the C, M and Y inks each reach 40 pl were separately used. Ejection conditions are shown in Table 5.

<Evaluation>

Ink-jet recording was conducted under the conditions as described above, and the resultant color images were evaluated as to resistance to bleeding in accordance with the following evaluation method and standard. The results of the evaluation are shown in Table 5.

(8) Resistance to bleeding at boundaries between different colors:

Color print samples were prepared in such a manner that different colors adjoined each other to visually observe whether bleeding occurred or not and to rank them in accordance with the following standard. In these samples, colors used were seven colors of black, yellow, cyan and magenta, and red (R), green (G) and blue (B) which were produced by applying any two colors of cyan, magenta and yellow to overlap each other, thereby mixing them.

A: No bleeding was recognized at all boundaries between different colors;

B: Bleeding was slightly recognized, but no problems arose from the viewpoint of practical use;

C: Bleeding was conspicuously recognized at boundaries between red, green and blue colors, to which a greater amount of inks were applied;

D: Conspicuous bleeding was recognized at almost all boundaries between different colors.

The ejection conditions and evaluation results are shown collectively in Table 5.

TABLE 5

Ejection conditions and evaluation results

| | Amount of inks ejected (pl) | | Liquid composition | | Liq. comp./ink ejection ratio (%) | | | |
|---|---|---|---|---|---|---|---|---|
| Exptl. Ex. | Bk ink | Y,M, C ink | Kind | Amount ejected (pl) | Bk ink | Y,M, C ink | R,G, B ink | Bleeding |
| 45 | 80 | 45 | A | 20 | 25 | 44 | 22 | A |
| 46 | 80 | 45 | A | 10 | 13 | 22 | 11 | A |
| 47 | 80 | 45 | B | 20 | 25 | 44 | 22 | B |
| 48 | 80 | 45 | B | 10 | 13 | 22 | 11 | B |
| 49 | 80 | 45 | C | 20 | 25 | 44 | 22 | B |
| 50 | 80 | 45 | C | 10 | 13 | 22 | 11 | B |
| 51 | 80 | 45 | D | 20 | 25 | 44 | 22 | B |
| 52 | 80 | 45 | D | 10 | 13 | 22 | 11 | B |

Experimental Example 53

A recording head having two heating elements H1 and H2 in each nozzle as illustrated in FIG. 2 was used to conduct color recording with four inks of yellow (Y), magenta (M), cyan (C) and black (Bk) colors and a liquid composition.

The same color inks as those used in Experimental Example 45 were used, and the liquid composition A was used as the liquid composition like Experimental Example 45. As the construction of a recording head unit, the same one as in Experimental Example 45 was used to conduct color recording. The amount of the ink or liquid composition ejected from the recording head used in this experimental example is about 25 pl where energy is applied only to the heating element H1, about 40 pl where energy is applied only to the heating element H2, and about 70 pl where energy is applied to both heating elements H1 and H2. The minute regulation of the ejection quantities was carried out by changing a pulse length further applied to the heating elements H1 and H2 to control energy applied to the heating elements.

The recording was conducted by using such a recording head to apply energy to the heating elements in such a manner that the ejection quantities of the Bk ink and the liquid composition corresponded to those in Experimental Example 45. More specifically, the ejection quantity of the Bk ink was controlled by energizing the heating elements H1 and H2 so as to reach an ejection quantity of about 80 pl, the ejection quantities of the Y, M and C inks were controlled by energizing only the heating element H2 so as to reach an ejection quantity of about 45 pl, and the ejection quantity of the liquid composition was controlled by energizing only the heating element H1 so as to reach an ejection quantity of about 20 pl. Using this recording head, the same evaluation as in Experimental Examples 45 to 52 was performed. As a result, the resultant image samples obtained the same valuation results as in Experimental Example 45.

As described above, the ejection quantities can be changed though all the chips are common to each other. Therefore, this process is also advantageous from the viewpoint of cost because chips for all colors can be made common.

According to the present invention as described above in detail, the bronzing phenomenon is prevented, and high-quality images excellent in evenness of solid printed areas and high in water fastness can be formed. In addition, curling and cockling which occur on the recording medium after the formation of the images can be lessened with the reduction of the amount of the liquid composition to be used.

According to the present invention, the occurrence of bleeding is also prevented in addition to the above-described effects, in particular, when color images are formed. It is hence possible to form high-quality color images.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An inkjet recording process for forming an image by applying an ink to a recording medium in accordance with an ink-jet recording system, comprising the steps of:

(A) applying an ink containing a coloring material to an ink-applying region of the recording medium in accordance with the ink-jet recording system; and (B) applying a liquid composition which is different from the ink and reacts with the ink when the liquid composition contacts with the ink to the ink-applying region of the recording medium in accordance with the ink-jet recording system, wherein an amount of the liquid composition to be applied to the recording medium in the step (B) is from 10 to 45% by volume of an amount of the ink to be applied to the recording medium in the step (A).

2. The ink-jet recording process according to claim 1, wherein the formed image is a water-fast image.

3. The ink-jet recording process according to claim 1, wherein the liquid composition comprises at least one cationic substance.

4. The ink-jet recording process according to claim 1, wherein the liquid composition is applied in an amount not less than 25% by volume but less than 45% by volume of the amount of the ink to be applied to the ink-applying region.

5. The ink-jet recording process according to claim 1, wherein the liquid composition is applied in an amount not less than 25% by volume but not more than 45% by volume of the amount of the ink to be applied to the ink-applying region.

6. The ink-jet recording process according to claim 1, wherein the step (B) is performed prior to the step (A).

7. The ink-jet recording process according to claim 1, wherein the step (A) is performed prior to the step (B).

8. The ink-jet recording process according to claim 1, wherein recording of one pixel of the image is carried out by applying the ink in several applications.

9. The ink-jet recording process according to claim 1, wherein the individual steps are performed in order of the step (A), the step (B) and the step (A).

10. The ink-jet recording process according to claim 1, wherein the ink comprises a set of plural inks having different colors.

11. The ink-jet recording process according to claim 1, wherein the ink and the liquid composition are applied to the recording medium by using an ink-ejecting part equipped with a thermal energy generator and a liquid composition-ejecting part equipped with a thermal energy generator, and applying thermal energy generated from the respective thermal energy generators to the ink and the liquid composition, thereby ejecting the ink and the liquid composition from the ink-ejecting part and the liquid composition-ejecting part, respectively.

12. The ink-jet recording process according to claim 11, wherein the amount of the liquid composition to be applied to the ink-applying region is controlled by changing a heating value of the thermal energy generator of the liquid composition-electing part.

13. The ink-jet recording process according to claim 12, wherein the heat-generating area of the thermal energy generator of the liquid composition-ejecting part is varied, thereby changing the heating value.

14. The ink-jet recording process according to claim 12, wherein the ink-ejecting part and the liquid composition-ejecting part are each equipped with a plurality of thermal energy generators, which can independently generate heat, and the number of the thermal energy generators to be caused to generate heat is changed, thereby changing the heating value.

15. An ink-jet recording apparatus comprising:

a tank storing an ink containing a coloring material;

a tank storing a liquid composition which reacts with the ink when it contact with the ink;

means for ejecting the ink towards a region on a recording medium;

means for ejecting the liquid composition to the region, and control means for controlling an amount of the liquid composition to be applied to the region as to be 10 to 45% by volume of an amount of the ink to be applied to the region.

16. The ink-jet recording apparatus according to claim 15, wherein the ink-ejecting part and the liquid composition-ejecting part each comprise a thermal energy generator which generates heat.

17. The ink-jet recording apparatus according to claim 15, wherein the liquid composition is applied in an amount not less than 25% by volume but less than 45% by volume of the amount of the ink to be applied to the ink-applying region.

18. The ink-jet recording apparatus according to claim 15, wherein the liquid composition is applied in an amount not less than 25% by volume but not more than 45% by volume of the amount of the ink to be applied to the ink-applying region.

19. The ink-jet recording apparatus according to claim 16, wherein the ejection-control means controls the heating values of the thermal energy generators.

20. An image formed article comprising:

a recording medium; and an image formed on the recording medium, wherein the image is formed by performing, in accordance with an ink-jet recording system, a step (A) of applying an ink containing a coloring material to an ink-applying region of the recording medium; and a step (B) of applying a liquid composition which is different from the ink and reacts with the ink when it contacts with the ink to the ink-applying region of the recording medium in order of step (A) and step (B), or step (B) and step (A), and the liquid composition is applied in an amount of from 10 to 45% by volume of the amount of the ink to be applied to the ink-applying region.

21. A process for preventing a recording medium from curling in ink-jet recording with an ink and a liquid composition for improving water-fastness of an image recorded on the recording medium with the ink, said method comprising the steps of:

controlling the amount of ink applied to the recording medium at an ink applying position; and controlling an amount of the liquid composition applied to the position where the ink is applied on the recording medium to from 10 to 45% by volume of an amount of the ink applied to the position, wherein the liquid composition reacts with the ink when it contacts with the ink.

22. The inkjet recording process according to claim 1, wherein the ink contains an anionic dye and the liquid composition contains a cationic substance.

23. The ink-jet recording process according to claim 22, wherein the cationic substance is selected from the group consisting of a cationic surfactant, a cationic oligomer and a cationic polymer.

24. The ink-jet recording process according to claim 1, wherein the ink contains a anionic dye and the liquid composition contains an oligomer or a polymer of allylamine.

25. The ink-jet recording process according to claim 1, wherein the ink contains an anionic dye and the liquid composition contains polyallylamine hydrochloride and benzalkonium chloride.

26. The ink-jet recording process according to claim 1, wherein the ink contains an anionic dye and the liquid composition contains polyethyleneimine hydrochloride and cetyltrimethylammonium chloride.

27. The ink-jet recording process according to claim 1, wherein the ink contains an anionic dye and the liquid composition contains polyaminesulfone hydrochloride and benzalkonium chloride.

28. The ink-jet recording apparatus according to claim 15, wherein the means for ejecting the ink comprises a heater which generates thermal energy for ejecting the ink in a nozzle.

29. The ink-jet recording apparatus according to claim 15, wherein the means for ejecting the liquid composition comprises a heater which generates thermal energy for ejecting the liquid composition as the control means, the heater being capable of changing an amount of the thermal energy.

30. The ink-jet recording apparatus according to claim 15, wherein the means for ejecting ink and the means for ejecting the liquid composition have a common structure, and the common structure comprises a plurality of heaters, and the control means controls the number of the heater for generating the thermal energy.

31. An ink-jet recording process for forming an image by applying an ink to a recording medium in accordance with an ink-jet recording system, comprising the steps of:

(a) applying an ink containing a coloring material to an ink-applying region of the recording medium in accordance with the ink-jet recording system; and (b) applying a liquid composition which is different from the ink and reacts with the ink when the liquid composition contacts with the ink applied to the ink-applying region of the recording medium in accordance with the ink-jet recording system, wherein an amount of the liquid composition to be applied to the recording medium in the step (b) is from 25 to 45% by volume of an amount of the ink to be applied to the recording medium in the step (a), and wherein the ink contains an anionic dye and the liquid composition contains polyallylamine hydrochloride and benzalkonium chloride.

32. An ink-jet recording process for forming an image of a plurality of pixels by applying ink to a recording medium in accordance with an ink-jet recording system, comprising the steps of:

(a) applying a first ink containing a coloring material to a region of the recording medium where a pixel for the image is to be formed in accordance with the ink-jet recording system and forming a part of the pixel;

(b) applying a second ink containing a coloring material to a region adjacent the region where the first ink is applied so as to complete formation of the pixel; and (c) applying a liquid composition which is different from the first and the second inks and reacts with the inks when the liquid composition contacts with the inks applied to the region and adjacent region in accordance with the ink-jet recording system so as to react with the first and second inks at the regions, wherein an amount of the liquid composition to be applied to the recording medium in the step (c) is from 25 to 45% by volume of an amount of the ink to be applied to the recording medium in the step (a), and wherein the ink contains an anionic dye and the liquid composition contains polyallylamine hydrochloride and benzalkonium chloride.

33. The ink-jet recording process according to claim 32, wherein the step (c) is conducted between the steps (a) and (b).

* * * * *

UNITED STATES PATENT AND TRADEMARK OFFICE

CERTIFICATE OF CORRECTION

PATENT NO. : 6,158,856
DATED : December 12, 2000
INVENTOR(S) : Sato et al.

It is certified that error appears in the above-identified patent and that said Letters Patent is hereby corrected as shown below:

Title page, Item [56],
References Cited: FOREIGN PATENT DOCUMENTS, "363299971" should read -- 63-299971 --, "401069381" should read -- 64-69381 --, and "406099576" should read -- 6-99576 --.

Column 1,
Line 23, "apparatuser" should read -- apparatuses --.

Column 13,
Line 27, "36" should read -- 36, --.
Line 63, "36 28" should read -- 36, 28 --.

Column 16,
Line 62, "inkjet" should read -- ink-jet --.

Column 17,
Line 67, "contact" should read -- contacts --.

UNITED STATES PATENT AND TRADEMARK OFFICE

CERTIFICATE OF CORRECTION

PATENT NO. : 6,158,856
DATED : December 12, 2000
INVENTOR(S) : Sato et al.

It is certified that error appears in the above-identified patent and that said Letters Patent is hereby corrected as shown below:

Column 18,
Line 53, "inkjet" should read -- ink-jet --.
Line 61, "a" should read -- an --.

Signed and Sealed this

Fourteenth Day of August, 2001

Nicholas P. Godici

*Attest:*

*Attesting Officer*

NICHOLAS P. GODICI
*Acting Director of the United States Patent and Trademark Office*